US010729933B2

(12) United States Patent
Lammers

(10) Patent No.: US 10,729,933 B2
(45) Date of Patent: Aug. 4, 2020

(54) DYNAMIC ROWING SIMULATOR

(71) Applicant: RP3 Rowing B.V., Haaksbergen (NL)

(72) Inventor: Gerrit Jan Lammers, KW Haaksbergen (NL)

(73) Assignee: RP3 Rowing B.V. (NL)

( * ) Notice: Subject to any disclaimer, the term of this patent is extended or adjusted under 35 U.S.C. 154(b) by 129 days.

(21) Appl. No.: 15/885,155

(22) Filed: Jan. 31, 2018

(65) Prior Publication Data

US 2018/0214734 A1 Aug. 2, 2018

(30) Foreign Application Priority Data

Feb. 2, 2017 (EP) ..... 17154449
Mar. 9, 2017 (EP) ..... 17160034

(51) Int. Cl.
*A63B 21/22* (2006.01)
*A63B 21/008* (2006.01)
(Continued)

(52) U.S. Cl.
CPC ..... *A63B 22/0076* (2013.01); *A63B 21/225* (2013.01); *A63B 22/0087* (2013.01);
(Continued)

(58) Field of Classification Search
CPC ..... A63B 22/0076; A63B 22/0079; A63B 22/0082; A63B 22/0084; A63B 22/0087; A63B 22/0089; A63B 22/0092; A63B 22/0094; A63B 2022/0079; A63B 2022/0082; A63B 2022/0084; A63B 21/22; A63B 21/222; A63B 21/225; A63B 21/227; A63B 21/151; A63B 21/153; A63B 21/154; A63B 23/00; A63B 23/02; A63B 23/0205; A63B 23/0222; A63B 23/0227; A63B 23/0233; A63B 23/0244; A63B 23/035; A63B 23/03508; A63B 23/03516; A63B 23/0355; A63B 23/03575; A63B 23/03525; A63B 23/3575;
(Continued)

(56) References Cited

U.S. PATENT DOCUMENTS 1,782,728 A * 11/1930 Kiefer ..... A63B 22/0076 482/72
4,396,188 A 8/1983 Dreissigacker et al.
(Continued)

FOREIGN PATENT DOCUMENTS

WO 9722389 A1 6/1997

*Primary Examiner* — Andrew S Lo
*Assistant Examiner* — Zachary T Moore
(74) *Attorney, Agent, or Firm* — St. Onge Steward Johnston & Reens LLC

(57) ABSTRACT

An exercise device is disclosed including a first elongated structural member extending in a longitudinal direction. A resistance element is connected to the first elongated structural member, the resistance element providing a resistance force. A seat is connected to the first structural member, the seat includes a seating surface. A drive which drives the resistance element includes a handle to be held by a user. The seat and resistance element are moveable with respect to each other in a direction parallel to the longitudinal direction and a centroid of the resistance element is arranged lower than an upper edge of the first elongated structural member.

29 Claims, 7 Drawing Sheets

(51) Int. Cl.
*A63B 22/00* (2006.01)
*A63B 21/00* (2006.01)

(52) U.S. Cl.
CPC ..... *A63B 22/0089* (2013.01); *A63B 21/0084* (2013.01); *A63B 21/153* (2013.01); *A63B 21/157* (2013.01); *A63B 2022/0033* (2013.01); *A63B 2022/0035* (2013.01); *A63B 2022/0079* (2013.01); *A63B 2225/093* (2013.01)

(58) Field of Classification Search
CPC ..... A63B 23/03583; A63B 69/06; A63B 2069/062; A63B 2069/064; A63B 2069/066; A63B 2069/068
See application file for complete search history.

(56) References Cited

U.S. PATENT DOCUMENTS

| | | | | |
|---|---|---|---|---|
| 4,650,181 | A | 3/1987 | Yang | |
| 4,880,224 | A | 11/1989 | Jonas et al. | |
| 4,997,181 | A * | 3/1991 | Lo | A63B 21/0088 482/110 |
| 5,382,210 | A | 1/1995 | Rekers | |
| 5,441,469 | A | 8/1995 | Chern | |
| D367,508 | S | 2/1996 | Dreissigacker et al. | |
| 2004/0180761 | A1 * | 9/2004 | Liou | A63B 21/153 482/72 |
| 2008/0280736 | A1 | 11/2008 | D'Eredita | |
| 2011/0028278 | A1 | 2/2011 | Roach | |
| 2013/0035216 | A1 * | 2/2013 | Campbell | A63B 21/023 482/72 |
| 2016/0166870 | A1 * | 6/2016 | Lagree | A63B 21/023 482/142 |

* cited by examiner

DYNAMIC ROWING SIMULATOR

FIELD OF THE INVENTION

The invention relates to an exercise device. More specifically the invention relates to an exercise device for simulating rowing, i.e. a rowing machine or a rowing simulator.

BACKGROUND OF THE INVENTION

Known rowing simulators include those shown in U.S. Pat./Pub. Nos. 5,382,210; 2011/0028278; D367,508, 4,396,188; 2013/0035216. Such machines suffer from a number of disadvantages which are resolved by the invention disclosed and described herein.

First, each of the above references involve a flywheel which is supported via a rotating cantilever axle. Furthermore, the flywheel is always positioned to one side of (i.e. offset from) the central slide axis of the seat such that the chain drive can align with the seat center. The flywheel is driven at relatively high RPMs which requires precise balancing for a long life and consistent resistance. Since the flywheel rotates relatively fast and may be relatively heavy, gyroscopic forces generated can be significant. The fact that the flywheel is cantilevered about its rotating axle means that significant stresses are put on this axle which often also doubles as/includes a clutch/freewheel to enable a pulling action on a chain to rotate the flywheel and then be returned in an opposite direction.

Next, all of the above references involve a flywheel whose rotation axis is positioned above the bar or surface on which the seat slides. This raises the center of gravity of the machine and also has gyroscopic forces generated above the bar which tends to reduce stability of the overall machine.

2011/0028278 also suffers the disadvantage that the two bars are positioned at a width outside that of the seat which takes up additional space, especially in storage.

SUMMARY OF THE INVENTION

It is an object of the present invention to improve such an exercise device. The improvements may for instance relate to an increased stability and/or a more accurate simulation of rowing and/or by any other advantageous improvement that will become apparent from the description below and/or by practice of the invention.

Some objects of the invention include positioning the central axis of the flywheel below the bar. Other objects of the invention include positioning the flywheel between two bars. Additional objects of the invention include providing a spring on the rear leg of the flywheel to absorb compressive forces and to reduce compression of the user's back. Additional objects provide for a drive which extends from above to below the bar.

In one embodiment said exercise device comprises:—a first elongated structural member extending in a longitudinal direction; —a resistance element connected to said first structural member for providing a resistance force; —a seat connected to said first structural member, said seat comprising a seating surface; —a drive for driving said resistance element, said drive comprising a handle to be held by a user; wherein said seat and said resistance element are moveable with respect to each other in a direction parallel to the longitudinal direction of said first structural member.

A user using the exercise device may sit on the seating surface of the seat and may hold the handle. In a starting position, the seat may be relatively close to the resistance element and the legs of the user may be bent. The user may then push himself away from the resistance element using his legs until his legs are (almost) straight, thereby increasing the distance between the seat and the resistance element and pulling the handle of the drive in an outward direction to a first extended position, thereby driving the resistance element. Optionally after bending his back backwards and further pulling the handle towards his chest to a second extended position, the user may then return to the starting position, thereby reducing the distance between the seat and the resistance element, and the cycle may be repeated. The drive may be urged or retracted to a first unextended position, such that the drive and thereby the handle return in the direction of their first unextended position when the user returns to the starting position.

Both the seat and the resistance element may be directly or indirectly connected to the first structural member, either fixed or releasable. The seat may be in a fixed position relative to the first structural member and the resistance element may be moveable relative to and in particular along the first structural member, such that an increasing distance between the seat and the resistance element implies that the resistance element moves away from the user. Such an exercise device may be referred to as a dynamic rowing simulator. Alternatively the resistance element may be in a fixed position with respect to the first structural element and the seat may be moveable relative to and in particular along the first structural member, such that an increasing distance between the seat and the resistance element implies that the seat moves away from the resistance element in a direction backwards for the user seated on the seat. Alternatively yet, both the seat and the resistance element may be moveable with respect to and in particular along the structural member. The seat and/or the resistance element may thus be moveably connected to the structural member, for example by means of guiding wheels or any other suitable means. Said guiding wheels may be part of the seat and/or the resistance element and may be arranged in a guiding rails of the structural member or vice versa. The resistance element may comprise a housing that connects the resistance element to the structural member.

In use, the first elongated structural member is orientated such that said longitudinal direction is substantially horizontal. The first elongated structural member may for instance be a beam. Said beam may have any suitable cross-section, for example quadrangular, in particular square. Alternatively the first elongated structural member may be a plate-like member. It is noted that said elongated structural member is denoted in certain instances as the first elongated structural member. Said first elongated structural member may be the only structural member. In some cases, additional elongated structural members may be employed.

The resistance element may for example be a flywheel that is rotated by the drive when said drive is extended by the user. Alternatively the resistance element may be a fluid-filled container comprising a rotatable element that is rotated by the drive when said drive is extended by the user. The resistance element may provide a resistance force to resist the extension of the drive by the user. The exercise device may comprise system for retracting or urging the drive to said first unextended position when the user provides no or little force to oppose the retraction.

In an embodiment of the exercise device according to the invention a centroid of the resistance element is arranged lower than said seating surface. More specifically, the centroid of the resistance element may be arranged lower than said seating surface when the exercise device is in use and is placed on a floor or the like.

Placing the resistance element in such a position, the centroid of the resistance element will be situated lower than the user when the exercise device is in use. This resembles more closely a real rowing situation in which the resistance force is also provided lower than the user.

In particular a centre of gravity of the resistance element may be arranged lower than said seating surface.

Lower with respect to the seating surface is defined here in a direction towards a second surface of said seat, said second surface being a surface that opposes the seating surface of the seat.

In another embodiment of the exercise device according to the invention a centroid of said resistance element is arranged lower than an upper edge of said first structural member when the exercise device is in use. In particular, the centre of gravity of the resistance element may be arranged below the upper edge of the first structural member. The resistance element may be arranged either completely or partly below the upper edge of the first structural member. By arranging the centroid below the upper edge of said first structural member additional stability is achieved so that the exercise device is less likely to tilt and/or tumble.

In yet another embodiment of the exercise device according to the invention said drive comprises a first drive element connected to said resistance element and a second drive element connected to said first drive element, wherein said second drive element comprises said handle.

An advantage of providing two separate drive elements is that this provides more versatility in arranging the two drive elements and/or choosing suitable means for each drive element and/or for the location and/or orientation of the resistance element and/or easier maintenance.

For example, said first drive element may be driven in one direction, and only said second drive element may be moved between the unextended and extended positions thereof. A one-way clutch mechanism may be provided in such a manner that the first drive element moves in accordance with the second drive element when the user pulls the handle outwards to the extended position, but the first drive element does not move in accordance with the second drive element when the second drive element is retracted in the direction of its unextended position. As the first drive element moves continuously in one direction, the first drive element and the connection to the resistance element are less susceptible to damage or wear. The second drive element may be replaced more easily when it is worn down or damaged, as it may be easier accessible in comparison to the first drive element.

Further, by providing two drive elements the position and/or orientation of the resistance element may be chosen with more flexibility, as the first drive element may provide a bridge to a location from which the second drive element is retractable. The location from which the second drive element is retractable is preferably at a suitable height and in the middle of a user, such that this location is more or less fixed. By providing two drive elements the location from which the second drive element is retractable may be suitably chosen, while the first drive element will bridge the distance to the resistance element.

The first drive element and the second drive element may be connected to each other by any suitable means, for example by means of an axis and toothed gears.

The first drive element may for instance be a chain, belt, cable or the like. The second drive element may for instance be a chain, belt, cable or the like.

In yet another embodiment of the exercise device according to the invention the first drive element is and endless element, for example an endless chain, belt, cable or the like. Such an endless element may run around a first axis to drive the resistance element and it may run around a second axis where it is driven by the second drive element that is also connected to the second axis. Such and endless element, which is essentially arranged in a loop, can run continuously in a single direction for prolonged periods of time without requiring retraction. As described above, a one-way clutch mechanism may be provided such that the first drive element is not driven by the second drive element when the second drive element moves from its extended position towards its unextended position.

In yet another embodiment of the exercise device according to the invention said exercise device comprises a second elongated structural member extending in a longitudinal direction parallel to the longitudinal direction of the first structural member.

An exercise device comprising a first structural member and a second structural member may provide increased structural rigidity and increased stability.

A centre line of the second structural member may be arranged in the same horizontal plane as the first second structural member, i.e. at the same height. The second structural member may have the same dimensions and/or the same shape as the first structural member. The second structural member may be at a distance from the first structural member only in a horizontal direction perpendicular to the longitudinal direction of the first structural member. The resistance element and the seat may be connected to the first structural member and to the second structural member. The second structural member may therefore be of similar shape and function as the first structural member.

In yet another embodiment of the exercise device according to the invention a centroid of said resistance element is arranged in a vertical plane extending parallel to the longitudinal direction of said first structural member and intersecting the middle of said seat.

In such a configuration the resistance element may have a centroid in the same vertical plane as a user seated on the seat. Placing the resistance element in such a position creates a more stable and better balanced construction as the (often heavy) resistance element is arranged in a central location.

In particular, said resistance element may be provided symmetrically with respect to said vertical plane extending parallel to the longitudinal direction of said first structural member and intersecting the middle of said seat Said resistance element may for example be arranged horizontally or vertically. With a vertically arranged resistance element, wherein an axis of rotation of a rotatable resistance element, in particular of a flywheel or rotor thereof, extends horizontally, the resistance element is usually located off-centre with respect to the seat and thereby off-centre to the user. This is usually practical, because the drive element usually connects to an axis extending out of the resistance element in line with the axis of rotation of the resistance element, and in order to have the location from which the second drive element is retractable in a centre position for the user, the resistance element is provided off-centre. Providing two drive elements provides the advantage that both the resistance element and the location from which the second drive element is retractable may be provided in the centre of the user, while only the first drive element is off-centre.

In yet another embodiment of the exercise device according to the invention said resistance element is at least partly arranged between said first and second structural members.

The position of the resistance element between the first and the second structural member creates a more stable construction that is less likely to tilt or tumble.

In yet another embodiment of the exercise device according to the invention said drive comprises a gear mechanism.

The gear mechanism provides the advantage of being able to change the gearing ratio, which allows the user to exercise at different speeds and/or forces while the resistance element may still provide a constant and appropriate resistance.

Such a gear mechanism may be a system of gears and a derailleur, or another kind of gear system that allows changing the gearing ratio In yet another embodiment of the exercise device according to the invention said gear mechanism comprises a hub gear.

The hub gear allows for a compact gearing solution, as well as one that is robust and resistant to dirt and damage.

The hub gear may be mounted inside an axis, for instance inside the resistance element.

In yet another embodiment of the exercise device according to the invention the first elongated structural member and optionally the second elongated structural member is or are supported at least partly by at least one spring.

The at least one spring may allow the first elongated structural member and optionally the second elongated structural member to move slightly in a vertical direction when the exercise device is in use. Additionally the spring may increase stability of the exercise device by flexibly absorbing vibrations. The spring may also allow for the reduction of compressive forces in the user's back generated at the end of the simulated rowing stroke. It is understood that the term "spring" as used herein includes but is not limited to a metal coil structure and further includes other appropriate types of resilient or flexible devices that can be pressed or pulled but return to the former position when released to absorb energy or movement.

The at least one spring may for example be arranged at one or both longitudinal end zones of the first elongated structural member and optionally the second elongated structural member. Said at least one spring may in particular extend vertically between at least one longitudinal end zone of the first elongated structural member and optionally of the second elongated structural member and a supporting surface on which the exercise device is placed, for example a floor or the like.

The exercise device may comprise one or more legs to suspend at least the first elongated structural member. The legs may also suspend the second elongated structural member if it concerns an embodiment with a second elongated structural member. The spring may be integrated into said one or more legs. The spring may allow at least a part of the first elongated structural member and optionally the second elongated structural member to move with respect to the at least one leg.

In use, the spring may allow at least a part of the first elongated structural member and optionally the second elongated structural member, in particular an longitudinal end zone thereof, to move with respect to a supporting surface, for example a floor or the like, in a vertical or near vertical direction.

In yet another embodiment of the exercise device according to the invention the at least one spring is disposed at or near a rear end zone of the exercise device as seen by a user using the exercise device.

The rear end zone may also be defined as the end zone with respect to the seat that is away from the resistance element.

The spring arranged at the rear end zone of the exercise device may allow the rear end zone of the exercise device to move slightly in a vertical or near vertical direction with respect to the supporting surface when in use. The slight movement of the rear end zone of the exercise device may provide a more accurate simulation of rowing, because this resembles a vertical oscillation, i.e. a sort of dip a boat makes towards an end of a rowing stroke i.e. about when the user has moved the handle to the second extended position.

The spring may allow the rear end zone of the exercise device, as seen by a user using the device, to move slightly downwards temporarily, as seen by a user using the device, when the user has pushed himself (almost) rearwards, i.e. away from the resistance element.

In yet another embodiment of the exercise device according to the invention the at least one spring comprises a gas spring.

A gas spring may provide an appropriate stiffness and may be resistant to long term wear. Additionally a gas spring may provide an accurate simulation of rowing.

The flywheel or rotating portion of the resistance element may be supported on two sides of its axle with part of the drive connected to one side thereof. In addition, in the embodiment with two elongated structural members, the flywheel may be arranged such that part thereof in a space between the two elongated structural members and such that part of the flywheel rotates in that space.

In other embodiments an exercise device is provided including an elongated structural member extending in a longitudinal direction. A resistance element is connected to the elongated structural member, the resistance element provides a resistance force and has a rotating flywheel member which rotates about an axle having an axis of rotation substantially perpendicular to the longitudinal direction. The axle is supported from two sides, the two sides positioned such that the rotating flywheel member rotates between the two sides. A seat is connected to the elongated structural member, the seat includes a seating surface having a center. A drive is provided which drives the resistance element, the drive includes a handle to be held by a user connected to a flexible elongate member. The flexible elongate member is configured to be pulled by a user parallel to the longitudinal direction and substantially centered with respect to a vertical plane passing through the center of the seat. The rotating flywheel element is positioned such that the two sides are positioned on either side of the vertical plane.

In certain aspects the seat is moveable with respect to the resistance element in a direction parallel to the longitudinal direction of the elongated structural member. In other aspects, the resistance element is moveable with respect to the seat in a direction parallel to the longitudinal direction of the elongated structural member. In other aspects, the resistance element and the seat are movable in the direction parallel to the longitudinal direction of the elongated structural member. In other aspects the elongated structural member comprises two elongated members spaced apart at a distance with at least part of the rotating flywheel member positioned between the two elongated members. In other aspects, the elongated structural member comprises two elongated members spaced apart at a distance to create a space therebetween and at least part of the drive passes through the space. In other aspects the exercise device includes a foot support element having left and right foot support areas with a space between the left and right foot support areas, wherein the elongated structural member is aligned with the space. In other aspects, the exercise device includes a foot support element having left and right foot support areas with a space between the left and right foot support areas, wherein the elongated structural member is aligned with the space. In other aspects, the axis is located lower than an upper edge of the elongated structural member. In yet other aspects, at least part of the drive element extends from above to below the elongated structural member, passing through a horizontal plane containing part of the elongated structural member.

In other embodiments, an exercise device is provided including an elongated structural member extending in a longitudinal direction. A resistance element is connected to the elongated structural member, the resistance element provides a resistance force. A seat is connected to the elongated structural member, the seat includes a seating surface. A drive which drives the resistance element includes a handle to be held by a user connected to a flexible elongate member. A first support is connected to one side of the elongated structural member and extends in a downward direction with respect to the elongated structural member. A second support has first and second ends, the first end connected to another side of the elongated structural member, the second support extending in a downward direction with respect to the elongated structural member. A spring element is positioned between the first and second ends of the second support thereby allowing the second support to extend and retract to change a distance between the first and second ends and absorb force.

In certain aspects, the spring is positioned such that the seat is between the spring and the resistance element in relation to the longitudinal direction. In other aspects, the seat and said resistance element are moveable with respect to each other in a direction parallel to the longitudinal direction of said elongated structural member.

BRIEF DESCRIPTION OF THE DRAWINGS

In all figures, like reference numerals represent like parts.

DETAILED DESCRIPTION OF THE INVENTION

Directions such as vertical and horizontal are used to provide information on the orientation of parts in a normal use of the exercise device. Front and rear are defined as seen by a user using the exercise device in a normal way.

Figure 1:
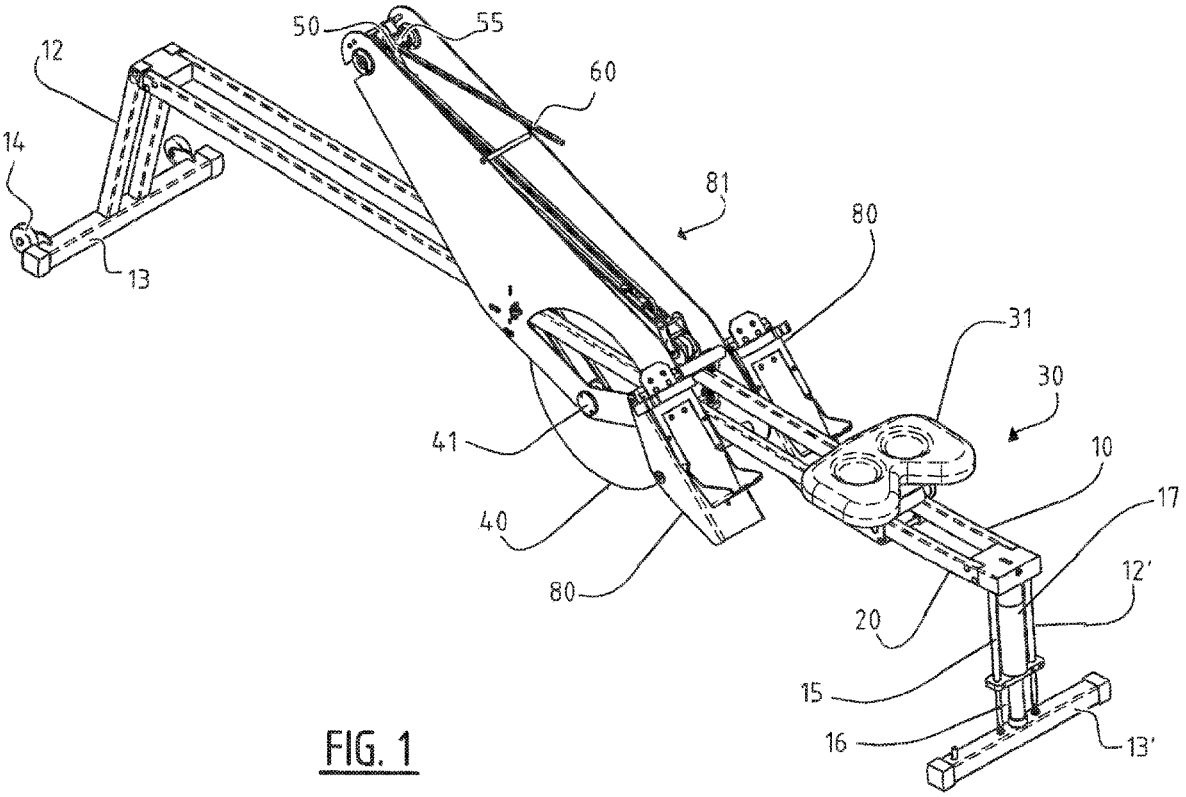
FIG. 1 shows a schematic perspective view of an exercise device according to the invention.

FIG. 1 shows an exercise device 1 according to an embodiment of the invention. The exercise device 1 is in particular a rowing simulator, also referred to as rowing machine. In this example the exercise device has two vertically arranged legs 12, 12' that support a first elongated structural member 10 and a second elongated structural member 20, such that the first and second structural members 10, 20 extend more or less horizontally at a predetermined, chosen distance or height from a floor or the like on which the device 1 is placed. The legs 12, 12' connect to horizontal beams 13, 13' which rest on the floor and which extend substantially transverse to the longitudinal direction of the first and second structural members 10, 20 in order to provide stability to the exercise device 1. In this embodiment the front beam 13 is provided with transport wheels 14. In this embodiment the rear leg 12' is adjustable in height, such that the structural members 10, 20 may be adjusted between extending horizontally and slightly inclined. The two structural members 10, 20 are here of the same size and shape and are disposed parallel to each other between the legs 12, 12'. A seat 30 is moveably attached to the two structural members 10, 20, such that the seat 30 may be moved along at least a part of the length of the two structural members 10, 20. The seat 30 has an upper seating surface 31 on which a user may sit. Furthermore the exercise device 1 comprises a resistance element, in this example a flywheel, 40 that is disposed vertically and symmetrically with respect to a vertical plane p that is parallel to the elongated structural members 10, 20 and passes through the centre of the seat 30, see also FIG. 3. As in this example the seat 30 is connected to the structural members 10, 20 in a symmetrical (centred) way, the resistance element 40 is also centred with respect to the structural members 10, 20 and the exercise device 1 in general. The resistance element 40 has a centroid 41, defined as the geometric centre of the resistance element 40, which centroid 41 is located at a lower position than the seating surface 31. In this case the centroid 41 is also lower than the seat 30 and the structural members 10, 20. The resistance element 40 is disposed partly between the structural members 10, 20. The resistance element 40 is connected to first and second drive 50, 60. The resistance element 40 and first and second drive 50, 60 are in this embodiment at least partly accommodated in a housing 81, which housing 81 is moveably attached to the two structural members 10, 20 such that the housing 81 may be moved along at least a part of the length of the two structural members 10, 20. Additionally the exercise device 1 according to this embodiment includes two foot rests 80 for the user to rest his/her feet on and/or to push against, which foot rests 80 are attached to the housing 81.

The example embodiment in FIG. 1 also shows a spring 17 that supports the first elongated structural member 10 and the second elongated structural member 20. The spring 17 is disposed at the rear end zone of the exercise device 1 as seen from a user using the exercise device 1. In this example the spring 17 are attached to the first elongated structural member 10 and the second structural member 20 at a rear end zones of the first elongated structural member 10 and the second structural member 20. The spring 17 are integrated in the leg 12', i.e. more or less form the leg 12'. The spring 17 allow at least a part of the first elongated structural member and the second elongated structural member to move slightly in the longitudinal direction of the leg 12' in which the spring 17 is integrated, i.e. with respect to a supporting surface on which the exercise device is placed, for example a floor or the like. In this example the spring 17 is a gas spring comprising a cylinder 15 and a piston 16. The cylinder 15 is connected to the end zones of the first elongated structural member 10 and the second elongated structural member 20 and the piston 16 is connected to horizontal beam 13'.

Figure 2:
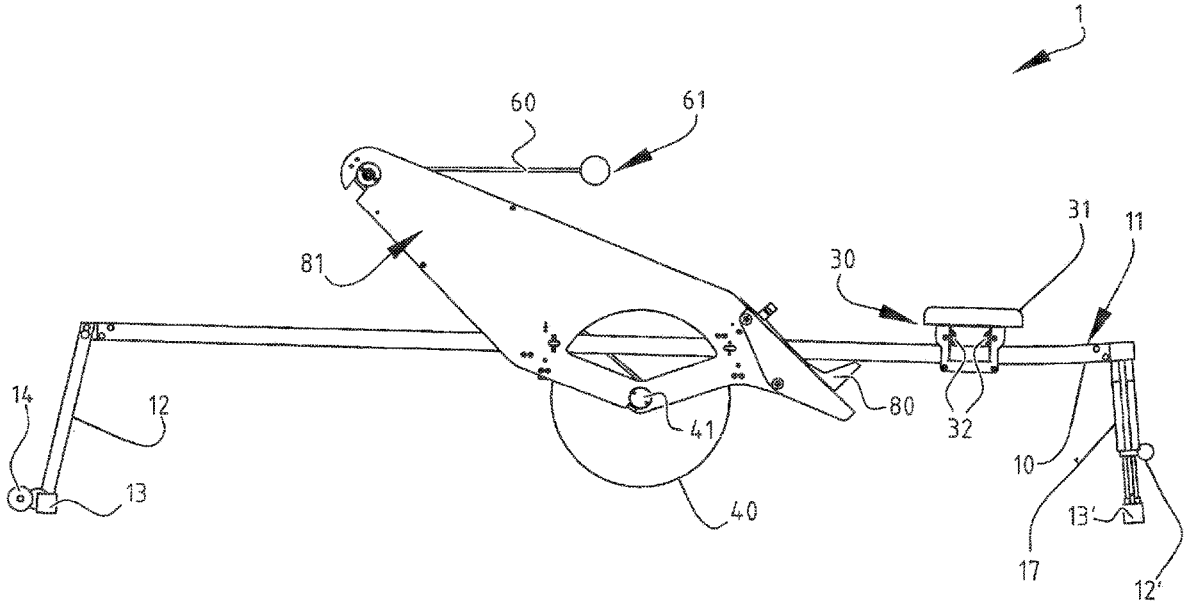
FIG. 2 shows a schematic side view of the exercise device of FIG. 1.

FIG. 2 shows a schematic side view of the exercise device 1 of FIG. 1. It is shown in FIG. 2 that the first elongated structural member 10 has an upper edge 11 and that the centroid 41 of the resistance element 40 is arranged lower as both this upper edge 11 of the first elongated structural member 10 and the seating surface 31. The upper edge of the second structural member 20 is not shown in FIG. 2, but this upper edge extends parallel to and at the same height as the upper edge 11 of the first structural member 10. The seat 30 comprises wheels 32 by means of which the seat 30 is moveable along the two structural members 10, 20. In FIG. 2 a handle 61 is schematically shown, which handle 61 is attached to a free outer end of second drive 60. The housing 81 includes a foot support or footstretcher 80 where the user's feet can push to separate the seat and resistance unit while holding the handle. The foot securing members show in FIG. 3 are spaced apart a distance sufficient such that the elongated members 10,20 can fit in the space therebetween.

Figure 3:
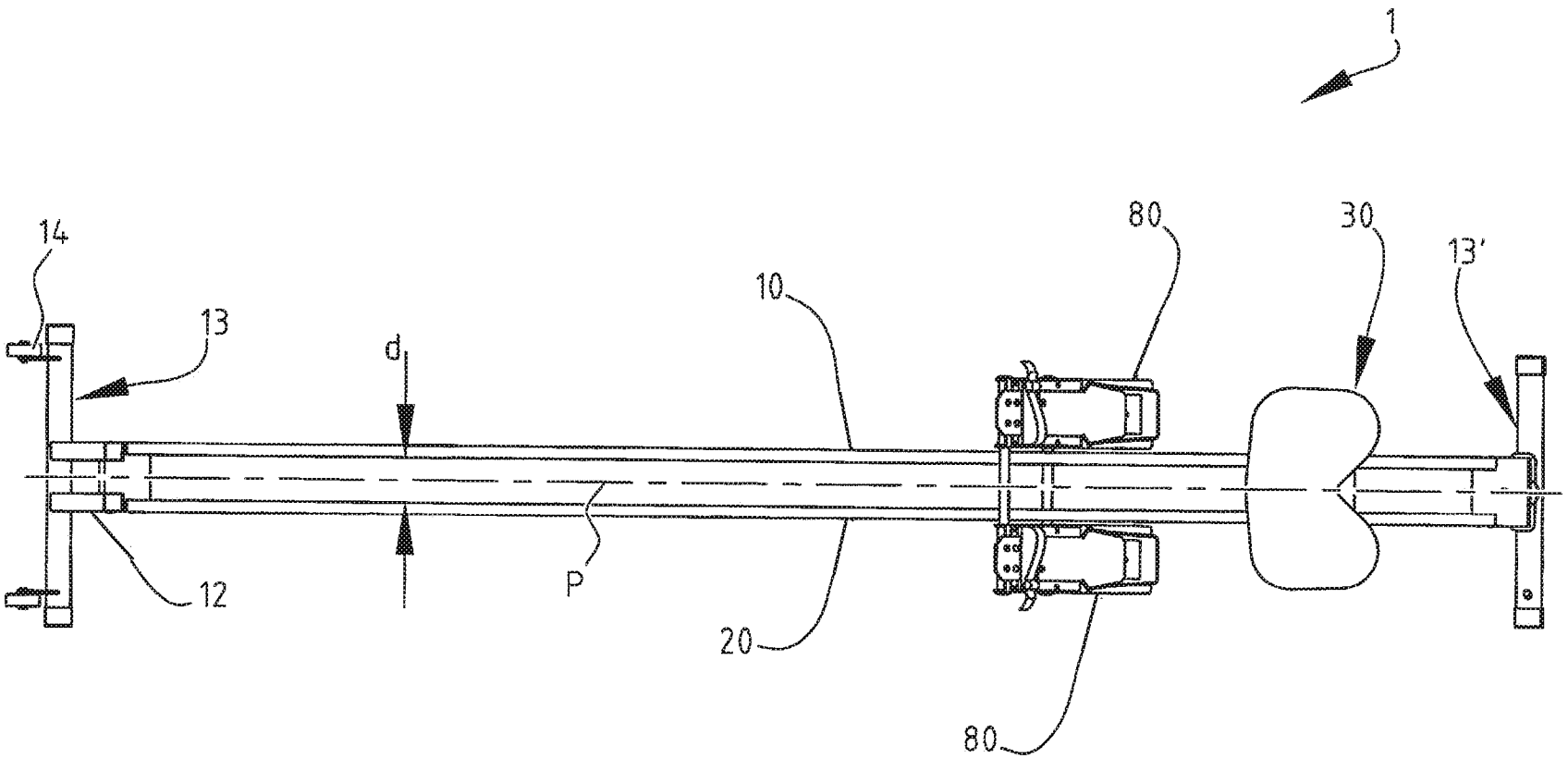
FIG. 3 shows a simplified schematic top view of the exercise device of FIG. 1.
Figure 4:
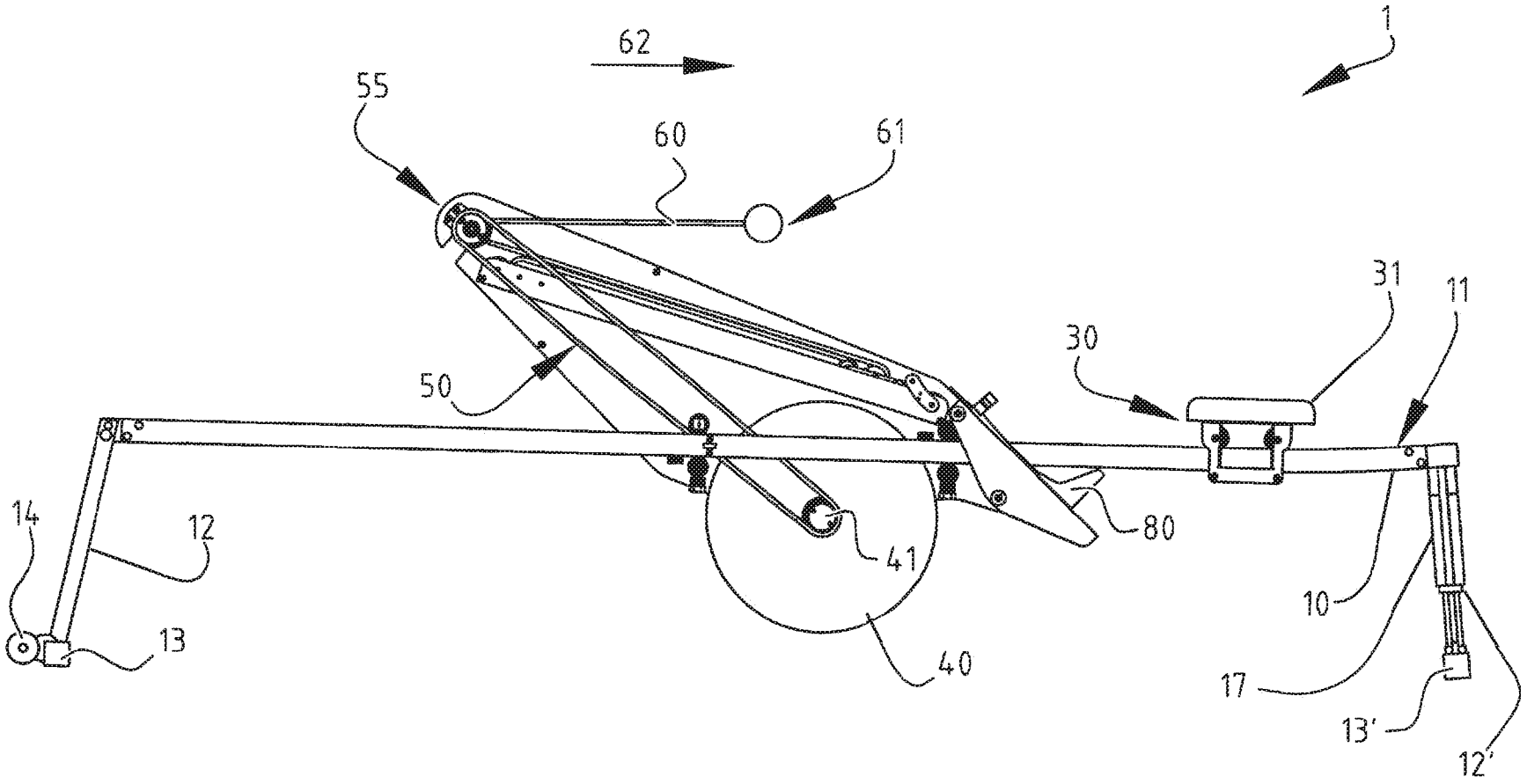
FIG. 4 shows a schematic open side view of the exercise device of FIG. 1.

In FIG. 3 is depicted a simplified top view of the exercise device 1. The exercise device 1 in FIG. 3 is simplified because FIG. 3 does not show the housing 81 with the resistance element 40 and the first and second drive 50, 60. These parts are left out in order to clearly show the two structural members 10, 20 which extend parallel to each other with a chosen distance d there between. The seat 30 connects to both structural members 10, 20 in the way described above. A vertical plane p that extends parallel to the longitudinal direction of the structural members 10, 20 and through the centre of the seat 30 is also shown in FIG. 3. The resistance element 40 (not shown in this figure) is arranged symmetrically with respect to this plane, such that the mass of the resistance element is provided symmetrically to the user sitting on the seat 30. The plane p may also be seen as the (vertical) plane of symmetry of the exercise device 1. The distance d is sufficient such that the flywheel 40 can rotate in the such space. FIG. 4 shows part of the flywheel 40 extending above and between the bars 10/20 but with the centroid or central axis positioned below the bars 10/20.

FIG. 4 is the side view of FIG. 2, but than partly open (i.e., one side of the housing 81 is left out). This FIG. 8 shows the first and second drive 50, 60 more clearly. The first drive 50 are in this embodiment an endless drive chain which connect to both the resistance element 40 and a transmission axis 55, see also FIG. 1. The second drive also connect to transmission axis 55. The second drive 60 comprise said handle 61 to be held by the user of the exercise device 1. When the user pulls the drive 60 in an outward direction with respect to the housing 81, said outward direction being indicated by arrow 62, the transmission axis 55 is rotationally driven, thereby also rotating the first drive 50 and thereby driving the resistance element 40. A one way clutch is provided such that when the second drive 60 return in an inward direction with respect to the housing 81, i.e. opposite to arrow 62, the first drive 50 do not move in a reversed direction. This way the first drive 50 may continuously move in only one direction or may temporarily not move, but in particular not move in an opposite direction.

Figure 5:
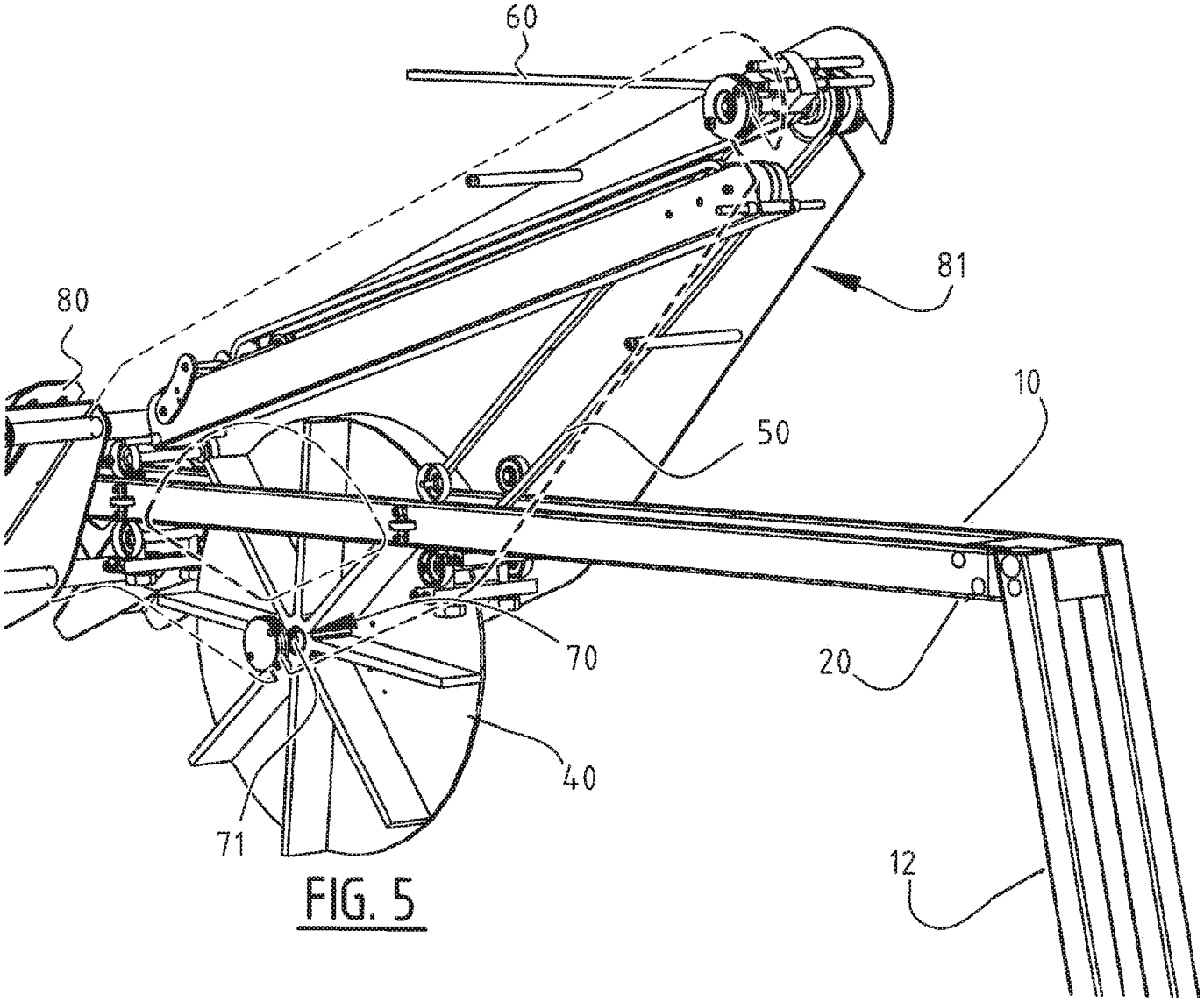
FIG. 5 shows a detail of the exercise device of FIG. 1 in a perspective view.

FIG. 5 shows a part of an exercise device 1 according to the invention in more detail, in which figure the housing 81 is partly transparent so that the resistance element 40 may be more clearly seen. The resistance element 40 is mounted to housing 81 by means of a rotatable axis 71 and is driven by said first drive 50 (not visible) that connect to said axis 71. A hub gear 70 is provided in said axis 71, which hub gear 70 may change the gearing ratio between drive 50 and resistance element 40. As can be seen in viewing FIGS. 2 and 5, the flywheel 40 is supported on both sides thereof, in certain embodiments by bearings. One side of the flywheel 40 has a gear or other element which engages the drive 50. As can be seen in FIG. 5 drive 50 extends from above to below the bars 10 and in certain aspects passes through the space between bars 10 and 20.

Figure 6A:
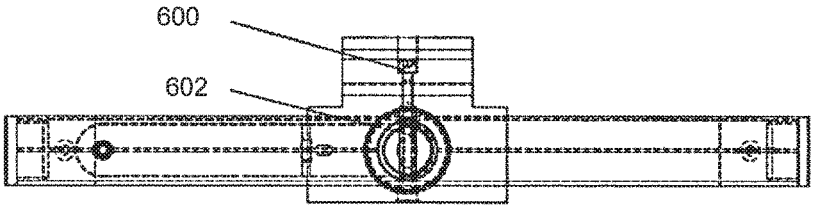
FIGS. 6A-C respectively show top, perspective and rear views of one of the supports of the device in FIG. 1.
Figure 6B:
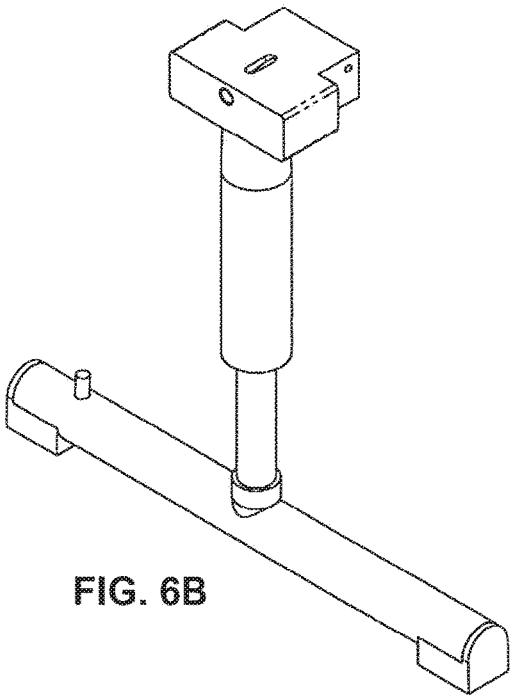
Figure 6C:
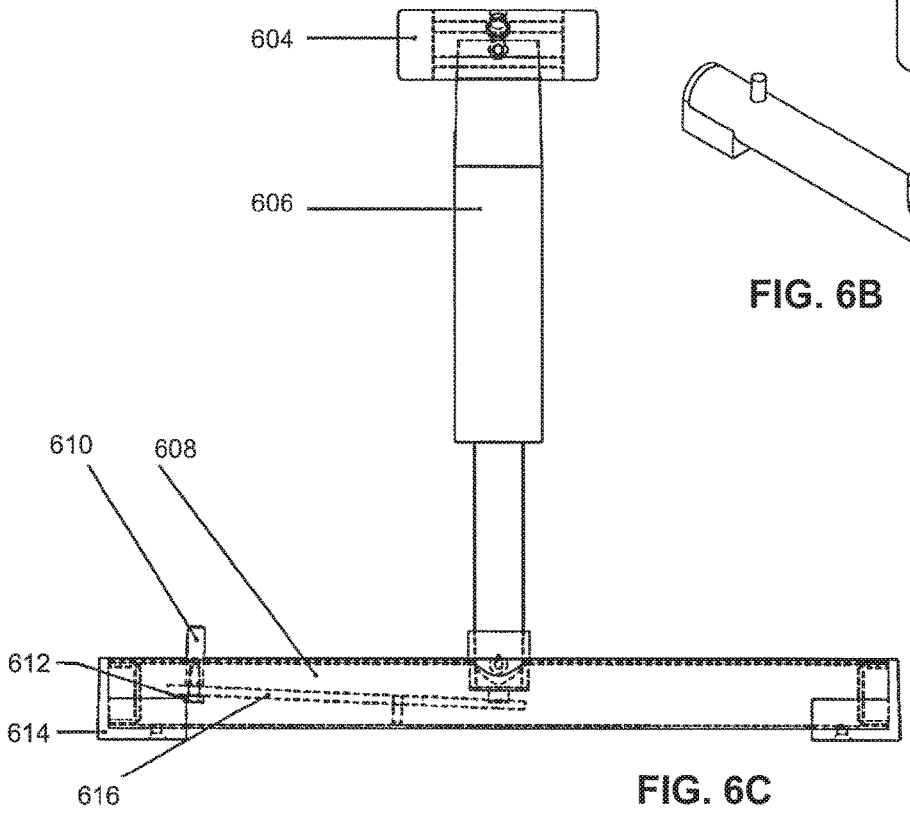

Referring to FIGS. 6A-C, the height adjustment mechanism is shown in further detail. This mechanism allows for the height of the elongated support to be moved up and down to account for uneven floors and/or to account for varied weights of the user. The block 604 connects to the elongated support(s). The actuator 610 can be depressed by the user to rotate bar 616 about a fulcrum to depress the button at the bottom of the spring. The bar 616 is on the inside of bar 608. A screw 612 connects the actuator 610 to the bar 616. Once the actuator is depressed the cylinder 606 can extend or retract to the desired height. The block 604 may be included with a level indicator 602 (bubble level) which the user can see to ensure proper positioning. The actuator 610 is then released and the spring (shown as a gas spring) will operate from the position set based on the level or other indicator the user desires to utilize. The screw 600 may adjust a tension/resistance rate of the cylinder 606. The support is shown with plastic or nylon feet ends 614 that reduce or prevent marking/scratching of the floor and/or slipping of the device. When reaching what is referred to in rowing as the "finish position" the spring may depress, thus absorbing some of the compressive forces which would otherwise be transferred into the user's spine if not for the spring. It is understood that the foregoing shows a specific embodiment of a gas spring but that the scope of the disclosure extends to other types of spring/resistance elements which can be positioned to absorb vertical forces. As can be seen the spring/cylinder 606 is integrally part of the support for the elongated structural member. In preferred embodiments, the spring is part of the rear support element. The actuator is positioned spaced off center from the spring so that when the user sits on the seat, that user's heel can be positioned to depress the actuator and the user can then use their body weight to assist in adjusting the unloaded position of the spring. It is understood that the unloaded position relates to when the exercise device is assembled but not being used/occupied.

Figure 7:
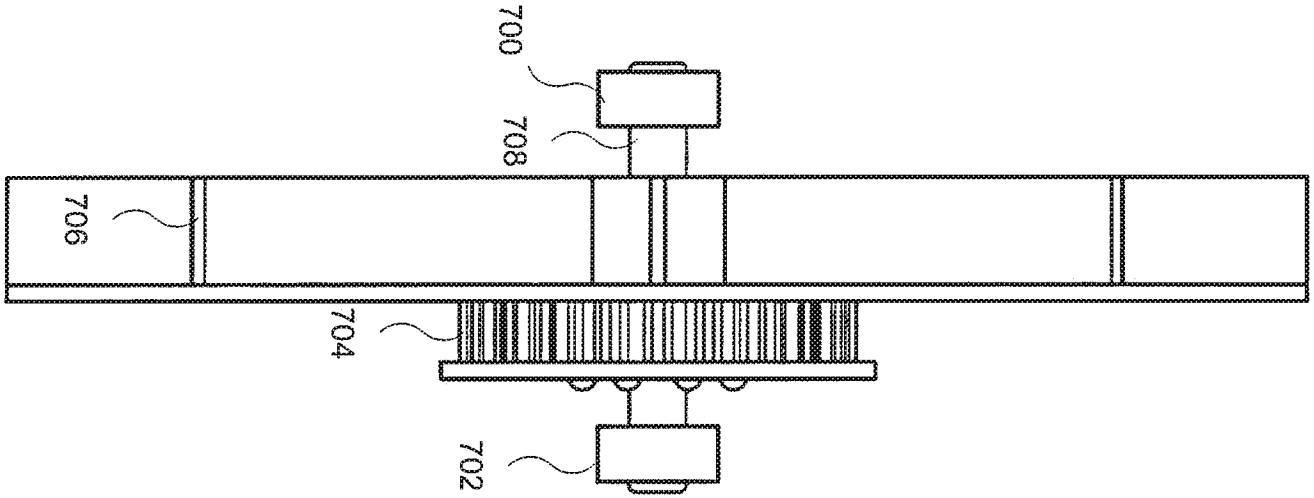
FIG. 7 shows a bottom view of a flywheel of the device in FIG. 1.

FIG. 7 shows further detail of the flywheel which includes bearings 700/702 on either side thereof. A sprocket or gear 704 connects to the drive system, in certain embodiments the continuous drive element connects to gear 704. Vanes 706 provide air resistance when the flywheel is spinning. The shaft 708 has the bearings, gear and flywheel connected thereto. The bearings 700/702 provide support to the flywheel on both sides thereof to reduce the effects of gyroscopic forces and provide longer life through reducing the stresses on the shaft/axle 708. Typical rowing simulators have been provided with a cantilever style shaft where the flywheel is supported from only one side which may result in more difficulty balancing the flywheel which can often spin at a relatively high rate of RPMs. However, by lowering the flywheel, it can now be centered without interfering with the handle/drive. The drive element can incorporate the flexible elongated member (e.g. a chain) which is connected to a bungee element/pulley system which allows the chain to return on its own due to bungee retraction from finish to catch. This chain then drives the continuous element 50 which passes from above to below the elongated structural member. Thus, the user drives the flywheel from a centered position relative to the seat and this force is transferred to the offcenter continuous element 50 which connects to the sprocket/gear 704 to drive the flywheel. The one way clutch/freewheel element may be part of the sprocket/gear 704 or may be positioned closer to the transmission axis. As shown in FIG. 2 the handle extends on either side of the second drive 60 such that the second drive 60 connects to the handle approximately in a middle thereof. In this manner, the user can hold either side of the handle to pull the second drive 60 which causes the resistance element to rotate. Therefore, the handle can be held such that it is pulled in a manner that allows the user to remain centered with respect to the seat and the foot support elements and for the handle to generally be pulled along a straight path.

As also shown in FIG. 1, the foot rests 80 are on either side of the elongated structural member such that the user's feet can push on the foot rests to the outside of the elongated structural member (which may include two bars). The flywheel/resistance element rotates between It is noted that the invention is not limited to the shown embodiment but also extends to variants within the scope of the appended claims.

What is claimed is:

1. An exercise device, comprising:

a first elongated structural member extending in a longitudinal direction;

a housing movable in the longitudinal direction along said first elongated structural member;

a resistance element connected to said first elongated structural member and positioned in the housing, said resistance element providing a resistance force and configured to move in the longitudinal direction along said first elongated structural member;

a seat connected to said first structural member, said seat comprising a seating surface having a middle;

a drive which drives said resistance element, said drive including first and second drives, the first drive configured as an endless loop and the second drive comprising a handle and an elongated element, the handle having two ends to be held by a user and the elongated element connected to the handle between the two ends;

a foot rest connected to said housing;

wherein said seat and said housing are moveable with respect to each other and with respect to said first elongated structural member along said first elongated structural member;

wherein a centroid of said resistance element is arranged lower than an upper edge of said first elongated structural member and said second drive positioned such that the elongated element extends from a middle of the handle along a middle plane which passes through the middle of the seat and the first drive extends from above to below the first elongated structural member to drive said resistance element, wherein said first drive moves along the longitudinal direction with said resistance element.

2. An exercise device according to claim 1, wherein said centroid of said resistance element is positioned below the first elongated structural member.

3. An exercise device according to claim 2 further comprising:

a second elongated structural member extending in a longitudinal direction parallel to the longitudinal direction of the first elongated structural member, the housing connected to said second elongated structural member and the resistance element positioned between said first and second elongated structural members;

wherein said first drive extends from above to below the first and second elongated structural members and passes between the first and second elongated structural members.

4. An exercise device according to claim 1 further comprising:

a second elongated structural member extending in a longitudinal direction parallel to the longitudinal direction of the first elongated structural member the housing connected to said second elongated structural member and the resistance element positioned between said first and second elongated structural members;

wherein said first drive extends from above to below the first and second elongated structural members and passes between the first and second elongated structural members.

5. An exercise device according to claim 1, wherein the centroid of said resistance element is arranged in a vertical plane extending parallel to the longitudinal direction of said first structural member and intersecting the middle of said seat.

6. An exercise device according to claim 4, wherein said resistance element comprises a flywheel between two bearings and the first drive drives the flywheel off center with respect to middle plane.

7. An exercise device according claim 6, wherein a rotating portion of said resistance element is at least partly arranged between said first and second structural members.

8. An exercise device according to claim 4, wherein the first elongated structural member and the second elongated structural member are supported at least partly by least one spring.

9. An exercise device according to claim 8, wherein the at least one spring is disposed at or near a rear end zone of the first elongated structural member and the second elongated structural member, the rear end zone positioned on an end of the exercise device positioned such that the seat is between the end and the resistance element.

10. An exercise device according to claim 9, wherein the at least one spring comprises a gas spring.

11. An exercise device comprising:

an elongated structural member extending in a longitudinal direction;

a resistance element connected to said elongated structural member, said resistance element providing a resistance force and having a rotating flywheel member which rotates about an axle having an axis of rotation and has vanes which provide air resistance when the rotating flywheel member is spinning;

said axle supported from two bearings, the two bearings positioned such that the rotating flywheel member rotates between the two bearings, said resistance element moveable with respect to said elongated structural member;

a seat connected to said elongated structural member, said seat comprising a seating surface having a center and moveable with respect to said elongated structural member;

a drive which drives said resistance element, said drive comprising a handle to be held by a user connected to a flexible elongate member and an off center drive element which is driven by the flexible elongate member and drives the rotating flywheel member between the two bearings, wherein the off center drive extends from above to below said elongated structural member;

the flexible elongate member configured to be pulled by a user in a direction substantially aligned with respect to a vertical plane passing through the center of the seat;

the rotating flywheel element being positioned such that the two bearings are positioned on either side of the vertical plane.

12. The exercise device of claim 11 wherein said seat is moveable with respect to said resistance element along said elongated structural member.

13. The exercise device of claim 11 wherein said resistance element is moveable with respect to said seat along said elongated structural member.

14. The exercise device of claim 13 wherein said resistance element and said seat are movable along said elongated structural member.

15. The exercise device of claim 11 wherein said elongated structural member comprises two elongated members spaced apart at a distance with at least part of said rotating flywheel member positioned between the two elongated members.

16. The exercise device of claim 11 wherein said elongated structural member comprises two elongated members spaced apart at a distance to create a space therebetween and said off center drive element passes through the space.

17. The exercise device of claim 15 further comprising a foot support element having left and right foot support areas with a space between the left and right foot support areas, wherein the elongated structural member is aligned with the space.

18. The exercise device of claim 16 further comprising a foot support element having left and right foot support areas with a space between the left and right foot support areas, wherein the elongated structural member is aligned with the space.

19. The exercise device of claim 11 wherein the axis is located lower than an upper edge of said elongated structural member.

20. The exercise device of claim 11 wherein at least part of said drive element extends from above to below the elongated structural member, passing through a horizontal plane containing part of said elongated structural member.

21. An exercise device comprising:

an elongated structural member extending in a longitudinal direction;

a resistance element connected to said elongated structural member, said resistance element providing a resistance force and configured to move along the elongated structural member;

a seat connected to said elongated structural member, said seat comprising a seating surface and configured to move along the elongated structural member;

a drive which drives said resistance element, said drive comprising a handle to be held by a user connected to a flexible elongate member;

a support system connected to said elongated structural member and including a first support and a second support;

said first support connected to one side of the elongated structural member and extending in a downward direction with respect to the elongated structural member;

said second support having first and second ends, the first end connected to another side of the elongated structural member, the second support extending in a downward direction with respect to the elongated structural member;

a spring element positioned between the first and second ends of the second support thereby allowing the second support to extend and retract in a vertical direction to change a distance between the first and second ends and absorb force thereby allowing the another side of the elongated structural member to displace vertically wherein a height of the elongated structural member is adjustable separately from the ability to change the distance between the first and second ends in order to absorb force.

22. The exercise device of claim 21 wherein the spring is positioned such that the seat is between the spring and the resistance element in relation to the longitudinal direction.

23. The exercise device of claim 21 wherein said drive further comprises an off center drive element which extends from above to below the elongated structural member to drive the resistance element off center with respect to a middle plane in which the elongated structural member travels.

24. The exercise device of claim 21 wherein the second support has an unloaded length measured between the first and second ends which is adjustable.

25. The exercise device of claim 24 wherein the unloaded length is adjustable by activating an actuator positioned on the second support.

26. The exercise device of claim 21 wherein said elongated structural member comprises two bars spaced apart at a distance with the resistance element positioned between the two bars; and wherein said drive element comprises first and second drives, the first drive being an endless loop extending from above to below the elongated structural member and between the two bars.

27. An exercise device, comprising:

a first elongated structural member extending in a longitudinal direction;

a housing movable in the longitudinal direction along said first elongated structural member;

a resistance element connected to said first elongated structural member and positioned in the housing, said resistance element providing a resistance force and configured to move in the longitudinal direction along said first elongated structural member;

a seat connected to said first structural member, said seat comprising a seating surface having a middle;

a drive including an elongated element and a handle, the drive positioned at least partially in said housing and said drive drives said resistance element;

the handle positioned above the first elongated structural member and having two ends to be held by a user and the elongated element connected to the handle between the two ends;

a foot rest connected to said housing;

wherein said seat and said housing are moveable with respect to each other and with respect to said first elongated structural member along said first elongated structural member;

wherein a centroid of said resistance element is arranged lower than said first elongated structural member and said drive positioned such that the elongated element extends from a middle of the handle along a middle plane which passes through the middle of the seat and a portion of said drive moves along the longitudinal direction with said resistance element while passing from above to below the first elongated structural member.

28. The exercise device of claim 27 wherein a diameter of the resistance element is less than a height of the first elongated structural member.

29. The exercise device of claim 27 wherein the centroid is positioned below the first elongated structural member a distance which is less than a radius of the resistance element.

* * * * *